US009119510B2

(12) United States Patent
Lv

(10) Patent No.: US 9,119,510 B2
(45) Date of Patent: Sep. 1, 2015

(54) GLASS-WIPING DEVICE

(71) Applicant: ECOVACS Robotics Co., Ltd., Suzhou, Jiangsu (CN)

(72) Inventor: Xiaoming Lv, Suzhou (CN)

(73) Assignee: ECOVACS Robotics, Co., Ltd., Suzhou (CN)

( * ) Notice: Subject to any disclaimer, the term of this patent is extended or adjusted under 35 U.S.C. 154(b) by 0 days.

(21) Appl. No.: 14/389,850

(22) PCT Filed: Jan. 16, 2013

(86) PCT No.: PCT/CN2013/070550
§ 371 (c)(1),
(2) Date: Oct. 1, 2014

(87) PCT Pub. No.: WO2013/149505
PCT Pub. Date: Oct. 10, 2013

(65) Prior Publication Data

US 2015/0059109 A1 Mar. 5, 2015

(30) Foreign Application Priority Data

Apr. 5, 2012 (CN) ..... 2012 1 0097428

(51) Int. Cl.
*A47L 1/02* (2006.01)
*G08C 19/00* (2006.01)

(52) U.S. Cl.
CPC . *A47L 1/02* (2013.01); *G08C 19/00* (2013.01); *A47L 2201/00* (2013.01)

(58) Field of Classification Search
CPC ..... A47L 1/02; G08C 23/04; G08C 23/06
See application file for complete search history.

(56) References Cited

U.S. PATENT DOCUMENTS 4,955,924 A * 9/1990 Gorman ..... 15/103

FOREIGN PATENT DOCUMENTS

| | | | |
|---|---|---|---|
| CN | 2423971 | Y | 3/2001 |
| CN | 101940449 | A | 1/2011 |
| CN | 202751318 | U | 2/2013 |
| JP | H01195824 | A | 8/1989 |
| KR | 20060122513 | A | 11/2006 |

* cited by examiner

*Primary Examiner* — Randall Chin
(74) *Attorney, Agent, or Firm* — Bret E. Field; Daniel G. Stoddard; Bozicevic, Field & Francis LLP

(57) ABSTRACT

The present invention provides a glass-wiping device comprising a glass-wiping device body (1) and a signal-receiving device (30) arranged thereon. The signal-receiving device (30) receives a control signal transmitted by a remote control and the control signal controls the glass-wiping device body (1) into action. The control signal received by the signal-receiving device (30) comes from either the obverse side or reverse side of the glass-wiping device body (1), where the side of the glass-wiping device body (1) that is away from the surface of a glass (100) is the obverse side, and where the side in proximity to the surface of the glass (100) is the reverse side. Because of simplified structure, reduced costs and great controllability, the problem of the machine itself acting as an obstacle that blocks the signal is solved.

6 Claims, 3 Drawing Sheets

GLASS-WIPING DEVICE

FIELD OF THE INVENTION

The present invention relates to a technical field of manufacturing small household appliances, in particular to a glass-wiping device.

BACKGROUND ART

The glass-wiping device in the prior art can control actions of the device via a remote control. In general, the remote control transmits infrared signals. An infrared signal receiver is provided on a side of the glass-wiping device body directly facing the remote control. The signal receiver is connected to a control system. Upon receiving the infrared signal, the control system executes a corresponding instruction and performs a corresponding operation. However, when the glass-wiping device is cleaning the outside of a glass, the device itself will act as an obstacle that blocks the receiving of the infrared signal, leading to malfunction of the remote control.

SUMMARY OF THE INVENTION

The objective of the present invention aims to provide a glass-wiping device for overcoming the deficiency in the prior art. Because of simplified structure, reduced costs, high sensitivity and great controllability of the glass-wiping device of the present invention, the problem of the machine itself acting as an obstacle that blocks the signal is solved.

The objective of the present invention is realized through the following technical solution:

A glass-wiping device comprises a glass-wiping device body and a signal-receiving device arranged thereon. The signal-receiving device receives a control signal transmitted by a remote control and the control signal controls the glass-wiping device body into action. The control signal received by the signal-receiving device comes from either the obverse side or reverse side of the glass-wiping device body, where the side of the glass-wiping device body that is away from the surface of a glass is the obverse side, and where the side thereof in proximity to the surface of the glass is the reverse side.

To receive the signal, the signal-receiving device comprises a first signal-receiving head provided on the obverse side of the glass-wiping device body and a second signal-receiving head provided on the reverse side of the glass-wiping device body, the first signal-receiving head is configured to receive the control signal transmitted from the obverse side of the glass-wiping device body, and the second signal-receiving head is configured to receive the control signal transmitted from the reverse side of the glass-wiping device body.

The signal-receiving device comprises a third signal-receiving head provided in the glass-wiping device body. A space is formed between the obverse and reverse sides of the third signal-receiving head and a shell of the glass-wiping device body, and the space is hollow or is filled with transparent material.

To guide the light, a first light-guiding pole and a second light-guiding pole are provided in the space, one end of the first light-guiding pole and the second light-guiding pole is connected with the third signal-receiving head, and another end thereof is respectively extended to the obverse and reverse sides of the shell of the glass-wiping device body.

The first light-guiding pole and the second light-guiding pole are made of a transparent material including polycarbonate (PC), engineering plastic s-polyoxymethylene (POM) or acrylic.

The first light-guiding pole and the second light-guiding pole are adhered in the space in the glass-wiping device body, or fixed in the space in the glass-wiping device body through bolts.

The signal-receiving device comprises one or more fourth signal-receiving heads, which is detachably provided on the periphery of the shell of the glass-wiping device body.

In conclusion, because of simplified structure, reduced costs, high sensitivity and great controllability, the problem of the machine itself acting as the obstacle that blocks the signal is solved by the present invention.

The technical solutions of the present invention will be described in detail with reference to attached drawings and detailed embodiments.

DESCRIPTION OF ATTACHED DRAWINGS

DETAILED DESCRIPTION OF PREFERRED EMBODIMENTS

First Embodiment

Figure 1:
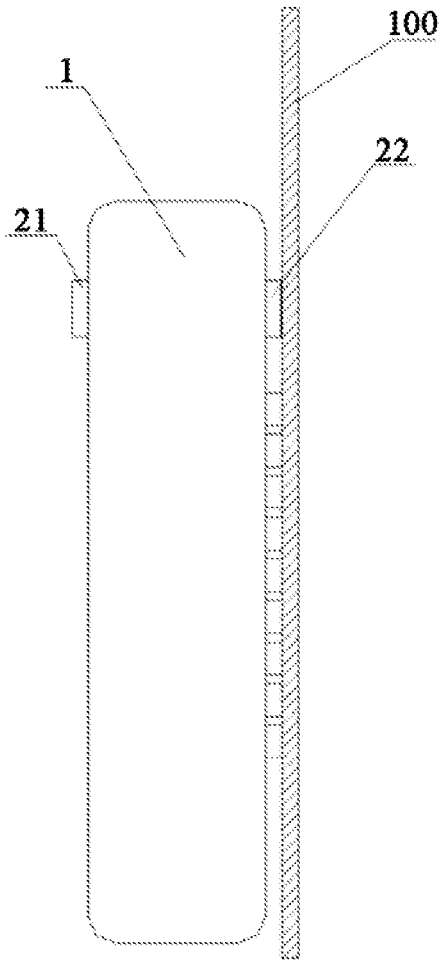
FIG. 1 is a schematic diagram of structure of the present invention according to a first embodiment.

FIG. 1 is a schematic diagram of structure of the present invention according to a first embodiment. As shown in FIG. 1, the present embodiment provides a glass-wiping device, comprising a glass-wiping device body 1 and a signal-receiving device arranged thereon. The signal-receiving device receives a control signal transmitted by a remote control and the control signal controls the glass-wiping device body 1 into action. The control signal received by the signal-receiving device comes from either the obverse side or reverse side of the glass-wiping device body. The obverse or reverse side mentioned herein is defined according to the position of the glass-wiping device body 1 relative to the surface of a glass 100. As shown in FIG. 1, when the glass-wiping device body 1 is operating on the surface of the glass 100, the side of the glass-wiping device body that is away from the surface of the glass 100 is the obverse side, and the side thereof in proximity to the surface of the glass 100 is the reverse side.

To receive the signal, the signal-receiving device comprises a first signal-receiving head 21 provided on the obverse side of the glass-wiping device body and a second signal-receiving head 22 provided on the reverse side of the glass-wiping device body, the first signal-receiving head 21 is configured to receive the control signal transmitted from the obverse side of the glass-wiping device body 1, and the second signal-receiving head 22 is configured to receive the control signal transmitted from the reverse side of the glass-wiping device 1.

Since the first signal-receiving head 21 and the second signal-receiving head 22 are respectively provided on the obverse and reverse sides of the glass-wiping device body 1 in this embodiment, in a process when the glass-wiping device body 1 is operating on the surface of the glass 100, a remote signal transmitted by the remote control regardless of being in whichever direction of the obverse and reverse sides of the glass-wiping device body 1 can be received by the first signal-receiving head 21 and/or the second signal-receiving head 22 provided on the obverse/reverse side, so that various actions of the glass-wiping device body 1 can be accurately controlled.

Second Embodiment

Figure 2:
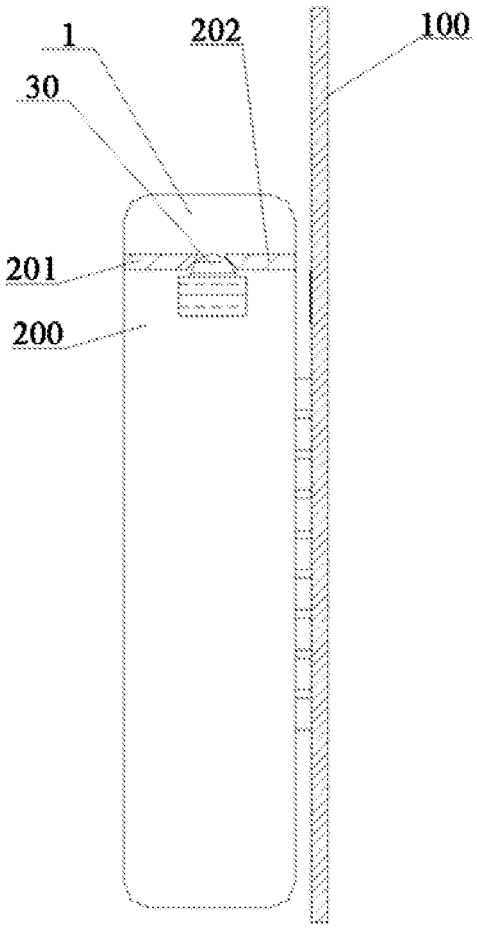
FIG. 2 is a schematic diagram of structure of the present invention according to a second embodiment.

FIG. 2 is a schematic diagram of structure of the present invention according to a second embodiment. As shown in FIG. 2, in this embodiment, in order that the structure of the glass-wiping device body can be further simplified and that the glass-wiping device body 1 can advantageously receive an infrared signal upon operating on both the inside and the outside of the glass 100, the signal-receiving device in the glass-wiping device body 1 comprises a third signal-receiving head 30 provided in the glass-wiping device body 1. A space 200 is formed between the obverse and reverse sides of the third signal-receiving head 30 and a shell of the glass-wiping device body 1, and the space 200 is hollow or is filled with transparent material (not shown). To guide the light, a first light-guiding pole 201 and a second light-guiding pole 202 are provided in the space 200, one end of the first light-guiding pole 201 and the second light-guiding pole 202 is connected with the third signal-receiving head 30, and another end thereof is respectively extended to the obverse and reverse sides of the shell of the glass-wiping device body 1. In order to guide the light, the light-guiding poles are made of a transparent material including PC (polycarbonate), POM (engineering plastics-polyoxymethylene) or acrylic. The first light-guiding pole 201 and the second light-guiding pole 202 are adhered in the space 200 in the glass-wiping device body 1 or fixed in the space 200 in the glass-wiping device body 1 through bolts.

Since the signal system of the glass-wiping device body 1 in this embodiment comprises the light-guiding poles respectively connected to the obverse and reverse sides of the glass-wiping device body, the received infrared remote control signal is transferred to the third signal-receiving head 30 by virtue of a light-guiding function of the light-guiding poles. A remote signal transmitted by the remote control regardless of being in whichever direction of the obverse and reverse sides of the glass-wiping device body 1 can be received by the third signal-receiving head 30, so that various actions of the glass-wiping device body 1 can be accurately controlled.

Third Embodiment

Figure 3:
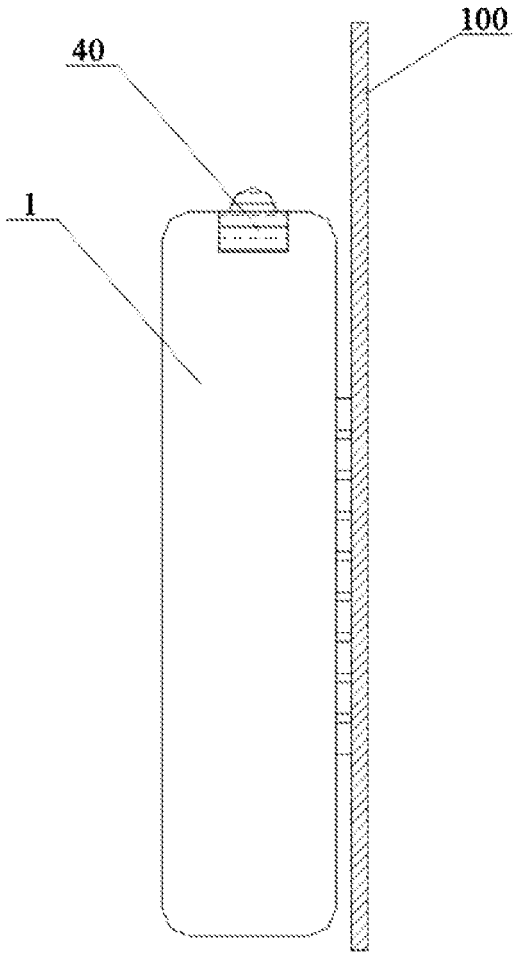
FIG. 3 is a schematic diagram of structure of the present invention according to a third embodiment.

FIG. 3 is a schematic diagram of structure of the present invention according to a third embodiment. The signal-receiving device comprises one or more fourth signal-receiving heads 40, which is provided on the periphery of the shell of the glass-wiping device body 1. As compared with a receiver provided in the body, the fourth signal receiving head 40 provided on the periphery of the body may be disposed as being detachable, so that it can be replaced more conveniently in case of damage. The number of the fourth signal-receiving heads 40 provided in this embodiment is at least one.

Since the signal system of the glass-wiping device body 1 in this embodiment comprises the fourth signal-receiving head 40 detachably provided on the periphery of the shell of the glass-wiping device body 1, and the end part of the fourth signal-receiving head 40 protrudes on the shell surface of the glass-wiping device body 1, a remote signal transmitted by the remote control regardless of being in whichever direction of the obverse and reverse sides of the glass-wiping device body 1 can be received by the fourth signal-receiving head 40, so that various actions of the glass-wiping device body 1 can be accurately controlled.

In conclusion, although the signal-receiving devices respectively provided in the control system of the glass-wiping device body have different structures from each other in the above-described three embodiments of the present invention, the same effect capable of receiving remote signals from both the obverse and reversed sides is achieved. Because of simplified structure, reduced costs, high sensitivity and great controllability of the invention, the problem of the machine itself acting as an obstacle that blocks the signal is solved.

The invention claimed is:

1. A glass-wiping device comprising a glass-wiping device body and a signal-receiving device arranged thereon, the signal-receiving device receives a control signal transmitted by a remote control, and the control signal controls the glass-wiping device body into action; wherein the control signal received by the signal-receiving device comes from either the obverse side or reverse side of the glass-wiping device body, where the side of the glass-wiping device body that is away from the surface of a glass is the obverse side, and where the side thereof in proximity to the surface of the glass is the reverse side; and wherein the signal-receiving device comprises a first signal-receiving head on the obverse side of the glass-wiping device body and a second signal-receiving head on the reverse side of the glass-wiping device body, the first signal-receiving head is configured to receive the control signal transmitted from the obverse side of the glass-wiping device body, and the second signal-receiving head is configured to receive the control signal transmitted from the reverse side of the glass-wiping device body.

2. A glass-wiping device comprising a glass-wiping device body and a signal-receiving device arranged thereon, the signal-receiving device receives a control signal transmitted by a remote control, and the control signal controls the glass-wiping device body into action; wherein the control signal received by the signal-receiving device comes from either the obverse side or reverse side of the glass-wiping device body, where the side of the glass-wiping device body that is away from the surface of a glass is the obverse side, and where the side thereof in proximity to the surface of the glass is the reverse side, and wherein the signal-receiving device comprises a signal-receiving head provided in the glass-wiping device body, a space is formed between the obverse and reverse sides of the signal-receiving head and a shell of the glass-wiping device body, and the space is hollow or is filled with transparent material.

3. The glass-wiping device according to claim 2, wherein a first light-guiding pole and a second light-guiding pole are provided in the space, one end of the first light-guiding pole and the second light-guiding pole is connected with the third signal-receiving head, and another end thereof is respectively extended to the obverse and reverse sides of the shell of the glass-wiping device body.

4. The glass-wiping device according to claim 3, wherein the first light-guiding pole and the second light-guiding pole are made of a transparent material including polycarbonate, engineering plastics-polyoxymethylene or acrylic.

5. The glass-wiping device according to claim 3, wherein the first light-guiding pole and the second light-guiding pole are adhered in the space in the glass-wiping device body.

6. The glass-wiping device according to claim 3, wherein the first light-guiding pole and the second light-guiding pole are fixed in the space in the glass-wiping device body by bolts.

* * * * *